US010557655B2

(12) United States Patent
Begarelli

(10) Patent No.: US 10,557,655 B2
(45) Date of Patent: Feb. 11, 2020

(54) SYSTEM FOR DEICING THE EXTERNAL EVAPORATOR IN A HEAT PUMP SYSTEM

(71) Applicant: BEGAFROST S.R.L., Verolavecchia (IT)

(72) Inventor: Bruno Begarelli, Verolavecchia (IT)

(73) Assignee: BEGAFROST S.R.L., Verolavecchia (IT)

( * ) Notice: Subject to any disclaimer, the term of this patent is extended or adjusted under 35 U.S.C. 154(b) by 0 days.

(21) Appl. No.: 15/757,619

(22) PCT Filed: Sep. 1, 2016

(86) PCT No.: PCT/EP2016/070642

§ 371 (c)(1),
(2) Date: Mar. 5, 2018

(87) PCT Pub. No.: WO2017/037189

PCT Pub. Date: Mar. 9, 2017

(65) Prior Publication Data

US 2018/0252450 A1 Sep. 6, 2018

(30) Foreign Application Priority Data

Sep. 3, 2015 (IT) ..... 102015000048188

(51) Int. Cl.
*F25B 47/02* (2006.01)
*F25B 13/00* (2006.01)

(52) U.S. Cl.
CPC ..... *F25B 47/02* (2013.01); *F25B 13/00* (2013.01); *F25B 2339/047* (2013.01); *F25B 2341/062* (2013.01); *F25B 2400/0409* (2013.01)

(58) Field of Classification Search
CPC ..... F25B 6/02; F25B 2339/047; F25B 5/02; F25B 5/25005; F25B 47/02;
(Continued)

(56) References Cited

U.S. PATENT DOCUMENTS 5,099,651 A 3/1992 Fischer
6,311,507 B1 * 11/2001 Gameiro ..... F25B 43/006 62/196.4
(Continued)

FOREIGN PATENT DOCUMENTS

EP 2048451 A1 4/2009

OTHER PUBLICATIONS

International Search Report dated Dec. 19, 2016 re: Application No. PCT/EP2016/070642; pp. 1-3.
(Continued)

*Primary Examiner* — Elizabeth J Martin
(74) *Attorney, Agent, or Firm* — Cantor Colburn LLP

(57) ABSTRACT

A system for deicing the external evaporator in a heat pump system, includes a refrigeration circuit connected in input and in output to the heat pump system and adapted to convey coolant gas. The refrigeration circuit includes a tank for storing a deicing fluid, and a first heat exchanger immersed in the deicing fluid. The system further includes a deicing circuit connected in input and in output to the tank and adapted to convey the deicing fluid. The deicing circuit includes a second heat exchanger arranged proximate to the external evaporator.

9 Claims, 2 Drawing Sheets

(58) Field of Classification Search
CPC ..... F25B 2341/0662; F25B 2400/0403; F25B 2400/0409; F25B 2400/0411; F25B 2341/062; F25B 2341/00; F25D 21/12
See application file for complete search history.

(56) References Cited

U.S. PATENT DOCUMENTS

| | | | | |
|---|---|---|---|---|
| 8,091,372 | B1 * | 1/2012 | Ekern | F25B 13/00 62/129 |
| 2003/0037553 | A1 * | 2/2003 | Sulc | B60H 1/00907 62/151 |
| 2006/0168976 | A1 * | 8/2006 | Flynn | F25B 9/006 62/196.4 |
| 2011/0146321 | A1 | 6/2011 | Jin | |
| 2014/0360216 | A1 * | 12/2014 | Boyko | F25B 47/02 62/278 |
| 2015/0159929 | A1 * | 6/2015 | Hancock | F25B 27/02 62/79 |
| 2015/0354837 | A1 * | 12/2015 | Asthana | F24F 1/027 454/204 |

OTHER PUBLICATIONS

Written Opinion dated Dec. 19, 2016 re: Application No. PCT/EP2016/070642; pp. 1-5.

* cited by examiner

SYSTEM FOR DEICING THE EXTERNAL EVAPORATOR IN A HEAT PUMP SYSTEM

TECHNICAL FIELD

The present disclosure relates to a system for deicing the external evaporator in a heat pump system, particularly, although not exclusively, useful and practical in the area of air conditioning systems adapted to heat or cool residential, commercial or industrial buildings.

BACKGROUND

If a heat pump system, such as for example an air conditioning system, is configured to operate as a heater, the corresponding exchanger or radiator installed in the external environment will operate as an evaporator and, for this reason, the temperature of its surface is fairly low.

When the external air is cold as well, typically during winter, with varying percentages of humidity, frost or ice will form on the surface of the external evaporator, causing a consequent reduction in the efficiency of the heat exchange, mainly owing to the insulating capacity of the ice and to the decrease in the spacing between the fins of the external evaporator.

Substantially, if the external radiator or exchanger operating as an evaporator is not periodically defrosted, the operation, and also the efficacy and efficiency, of the heat pump system will be negatively and considerably affected.

Usually, when the layer of frost or ice on the external evaporator is excessive, the power of the heat pump system will be reduced, the evaporation pressure of the cooling fluid will be modified, and malfunctions can arise, such as for example:

- a possible return of coolant gas in the liquid phase during suction by the compressor, causing damage to or the total breakage thereof,
- constant and sudden triggering of the deicing system, causing a waste of energy;
- a very low output of warm air from the internal exchanger operating as a condenser;
- a drastic lowering of the performance coefficient (up to 30%) from the performance specifications given by the maker.

The aim of the deicing cycle, also known as the defrosting cycle, is therefore to melt such frost or ice that has formed on the surface of the external evaporator; it can be carried out with different methods, according to the type of system and the different requirements.

The method of deicing that is used the most, in particular in the field of air conditioning, takes advantage of the possibility to combine both the heating function and the cooling function in a single heat pump, thus making it possible to proceed with the periodic deicing of the external evaporator by way of a cycle inversion, which makes it possible to make the high-temperature cooling fluid originating from the compressor, typically in the form of a gas, pass into the external evaporator to be deiced.

In conventional heat pump systems, such as for example conventional air conditioning systems, in order to melt this layer of ice, a reversible valve temporarily inverts the cycle of the cooling fluid, so as to change the direction of the flow of heat; in this way the roles are also inverted of the external radiator, which passes from acting as an evaporator to acting as a condenser, and of the internal radiator, which passes from acting as a condenser to acting as an evaporator.

Therefore, in a deicing cycle, the cooling fluid evaporates in the internal radiator and condenses in the external radiator, the internal and external ventilations stop, so as to reduce the heat energy necessary for the deicing, and the compressor compresses gas at high temperature in the external radiator, thus making it possible to melt the ice that has formed.

Usually, conventional heat pump systems have two or three deicing cycles per hour, which are executed at an external air temperature of +4÷5° C. and as a function of the humidity present.

Obviously, while the heat pump is in this deicing step, the internal radiator cools the air that is intended for example for the rooms of a building to be heated, and therefore there is a necessity to heat the air before putting it into circulation (this is known as preheating).

One of the biggest problems relates to the correct adjustment of the frequency of the deicing cycles. In fact, infrequent deicing cycles lead to the formation of ice very often on the surface of the external evaporator, worsening the heat exchange efficiency; while over-frequent deicing cycles lead to the introduction of cold air into the air conditioning system, with negative effects on the wellbeing of the end users, and energy waste, for example owing to frequent cooling fluid cycle inversions or to repeated preheating operations.

The adjustment of the duration of the deicing cycles is also strategic to the complete melting of the ice. In fact, if the deicing step is too short, not all of the frost or ice that is present on the external evaporator will be melted, and the remaining part tends to solidify more thickly and compactly when the deicing step ends and operation returns to the heating step.

SUMMARY

The aim of the present disclosure is to overcome the limitations of the known art described above, by devising a system for deicing the external evaporator in a heat pump system which makes it possible to obtain better effects and/or similar effects at lower cost with respect to those obtainable with conventional solutions, thus making it possible to completely replace the deicing step during the operation of the system, i.e. to avoid carrying out periodic deicing cycles that interrupt operation of the apparatus as a heating system.

Within this aim, the present disclosure provides a system for deicing the external evaporator in a heat pump system which makes it possible to avoid frequent cooling fluid cycle inversions, and also repeated preheating operations.

The present disclosure provides a system for deicing the external evaporator in a heat pump system which makes it possible to spare the apparatus from conditions of excessive stress, in this manner ensuring greater reliability of the mechanical and electrical parts, especially over the long term of service, and a consequent reduction of the number of maintenance operations necessary.

The present disclosure further provides a system for deicing the external evaporator in a heat pump system which makes it possible to increase performance in terms of absorptions, in heating mode (SCOP).

The present disclosure also provides a system for deicing the external evaporator in a heat pump system which makes it possible to increase performance in terms of absorptions, in cooling mode (SEER).

The present disclosure further provides a system for deicing the external evaporator in a heat pump system which is highly reliable, easily and practically implemented and low cost.

These advantages and features which will become better apparent hereinafter are achieved by providing a system for deicing the external evaporator in a heat pump system, characterized in that it comprises:

a refrigeration circuit, connected in input and in output to said heat pump system and adapted to convey coolant gas, said refrigeration circuit comprising a tank for storing a deicing fluid, and a first heat exchanger immersed in said deicing fluid; and a deicing circuit connected in input and in output to said tank and adapted to convey said deicing fluid, said deicing circuit comprising a second heat exchanger;

said second heat exchanger being arranged proximate to said external evaporator.

BRIEF DESCRIPTION OF THE DRAWINGS

Further characteristics and advantages of the disclosure will become better apparent from the description of some preferred, but not exclusive, embodiments of the system for deicing the external evaporator in a heat pump system according to the disclosure, which are illustrated by way of non-limiting example in the accompanying drawings, in which.

DETAILED DESCRIPTION OF THE DRAWINGS

Figure 1:
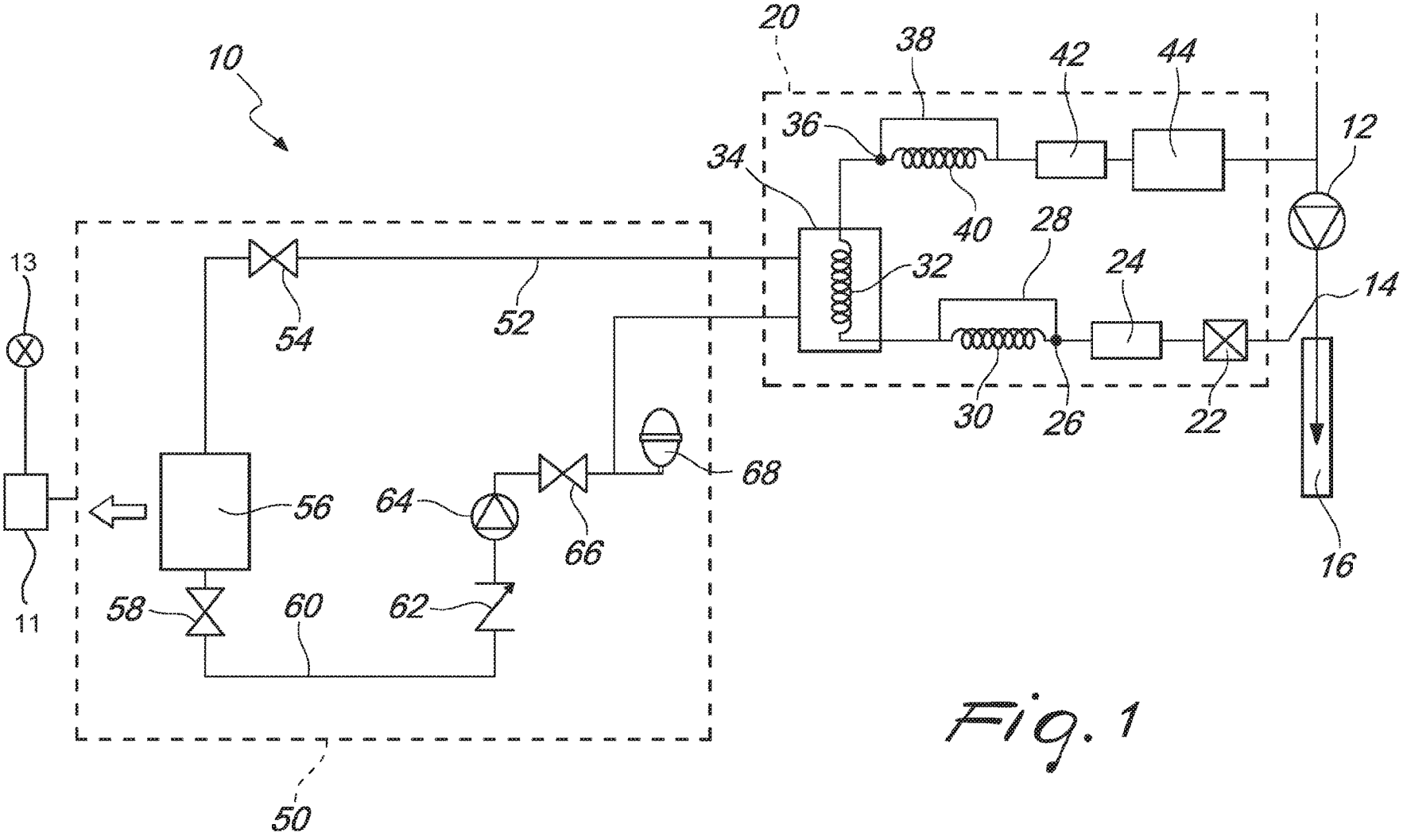
FIG. 1 is a block diagram of a first embodiment of a system for deicing the external evaporator in a heat pump system, according to the present disclosure.

FIG. 1 schematically illustrates a first embodiment of the system for deicing the external evaporator in a heat pump system according to the disclosure, generally designated by the reference numeral 10, if such system is integrated directly in a heat pump system, for example a conventional air conditioning system.

The compressor 12 of the heat pump system compresses the cooling fluid in the form of a gas and puts it into the circuit, activating the circulation thereof in the gaseous state, at high pressure and at high temperature.

By way of a three-way or Y connection 14, a first portion of coolant gas is redirected to a secondary refrigeration circuit 20, connected in input and in output to the heat pump system, while a second portion of coolant gas proceeds along the normal primary refrigeration circuit of the heat pump system, shown here in a simplified representation, for example a conventional conditioning system which comprises internal radiators 16 installed in the rooms of the building to be heated.

The first portion of coolant gas, which as mentioned is redirected to the secondary refrigeration circuit 20, proceeds toward a two-way, two-position opening control valve 22, which is adapted to activate (open) or deactivate (closed) the deicing system 10 as a function of the values of the external and internal ambient temperature, of the input and output temperature of the coolant gas, and of the humidity in contact with the external evaporator 11 of the system such values being measured by adapted probes or sensors 13, and also as a function of the needs of the context.

Once past the opening control valve 22, the coolant in the gaseous phase enters a gas accumulator 24.

After the accumulator 24, the coolant gas arrives at a three-way, two-position first redirection valve 26, by way of which it is redirected into a by-pass 28 in the direction of a first heat exchanger 32, preferably made of copper, where the change of state of the coolant from gaseous to liquid takes place.

The heat of the coolant gas is transferred to a deicing fluid, such as for example water, which is stored in a tank 34, which therefore acts as a condenser, the first exchanger 32 being immersed, preferably totally, in the aforementioned deicing fluid.

At the output from the first exchanger 32, i.e. as a consequence of the transfer of heat from the coolant, the latter is therefore in the liquid phase, at average temperature and average pressure.

Such liquid coolant is then conveyed to a second redirection valve 36, also three-way and two-position, which directs it toward a second heat exchanger 40, constituted preferably by a copper capillary tube, where the coolant passes from the liquid state to the vapor state.

After passing through the second heat exchanger 40, the coolant, which is now in the vapor state, enters a liquid accumulator 42, and proceeds toward a liquid separator 44.

Once inside the liquid separator 42, the coolant is ready to be sucked in once again by the compressor 12 and to resume its path from the start, in gaseous form.

Starting from the tank 34 for storing the deicing fluid, such as for example water, previously heated, a closed-circuit deicing circuit 50 is formed, which is therefore connected in input and in output to the tank 34.

The heated water is conveyed, through the delivery pipe 52, toward a two-way, two-position first flow control valve 54, which if open allows it to enter a heat exchanger 56 and release the heat energy that was previously acquired.

From inside the heat exchanger 56, positioned proximate to the external evaporator of the system, the water dissipates the heat in the form of hot air toward such external evaporator, thus preventing any formation of frost or ice and keeping the conventional air conditioning system 16 stable without arrests and swings m operation.

After exiting from the exchanger 56, the cooled water enters the return pipe 60 and arrives at a two-way, two-position second flow control valve 58, which allows it (open) or denies it (closed) the passage.

Subsequently, the cooled water passes through a non-return valve or check valve 62, a circulation pump 64, a third flow control valve 66, also two-way, two-position, and finally it reenters the storage tank 34 so that it can be heated again and reintroduced into circulation in the deicing circuit 50.

In a preferred embodiment of the present disclosure, the deicing circuit 50 advantageously comprises an expansion vessel 68, which performs the function of containing the pressure variations of the circuit, thus preventing hazardous sudden changes and water hammers, which otherwise would have to be absorbed by the piping and by the rest of the system.

Note that the system 10 for deicing the external evaporator in a heat pump system can also operate in cooling mode, so as to exchange cooled water in the exchanger 56 and favor the maintenance of low temperatures of the exchanger or external radiator, which in this case operates as a condenser.

To this end, it is sufficient to position the redirection valves 26 and 36 in the opposite positions to the ones described above, used in heating mode, so as to invert the condensation and the evaporation of the cooling fluid in the secondary refrigeration circuit 20.

In particular, in such case the cooling fluid first passes through a third heat exchanger 30, which is constituted preferably by a copper capillary tube, in place of the by-pass 28; and then through a by-pass 38 in place of the second heat exchanger 40.

Figure 2:
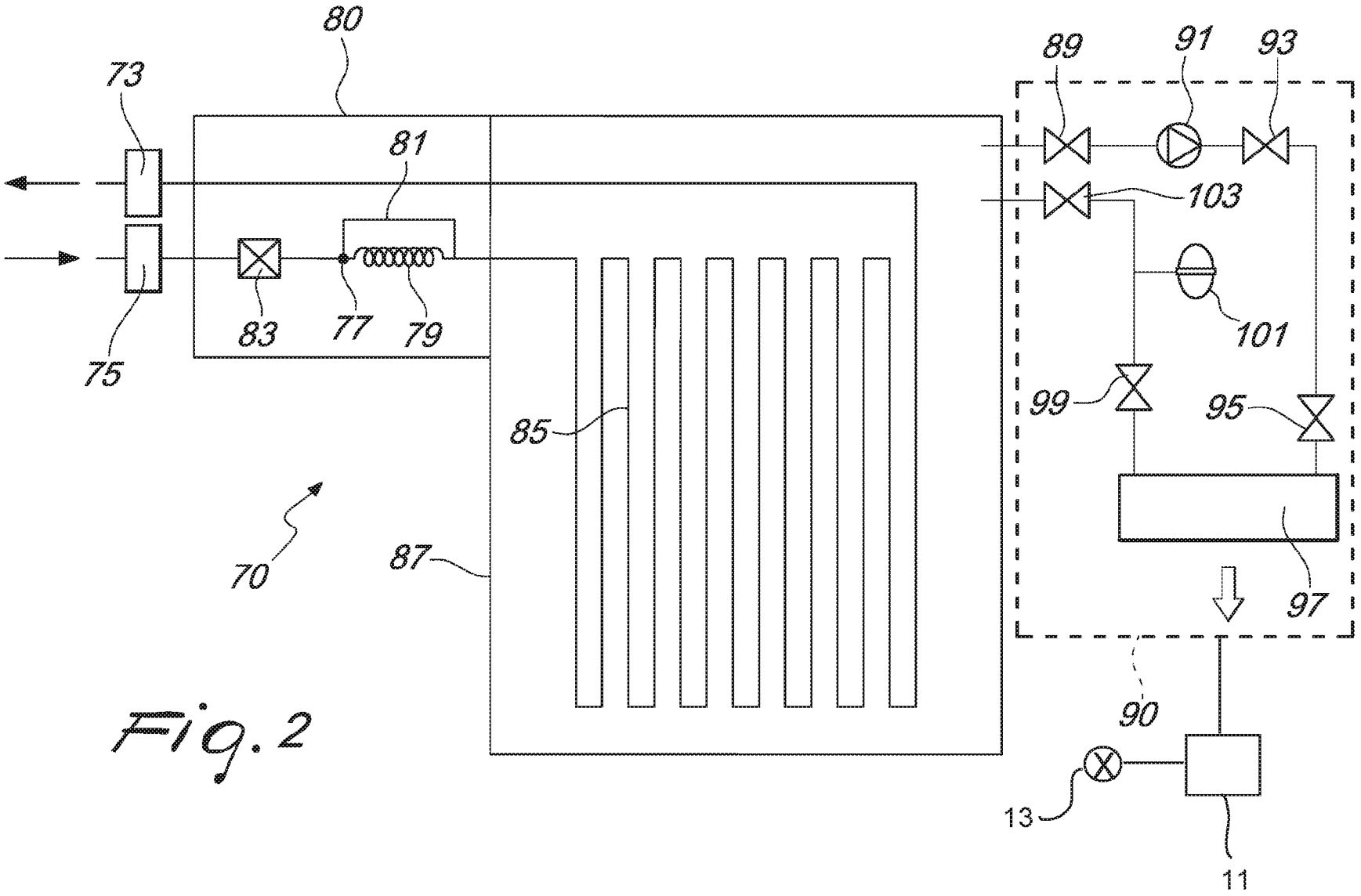
FIG. 2 is a block diagram of a second embodiment of the system for deicing the external evaporator in a heat pump system, according to the present disclosure.

FIG. 2 schematically illustrates a second embodiment of the system for deicing the external evaporator in a heat pump system according to the disclosure, generally designated by the reference numeral 70, if such system is connected externally to a heat pump system, for example a conventional conditioning system.

In practice, the deicing system 70 is constituted by a prefabricated kit, assembled in a single enclosure.

The cooling fluid in the gaseous state, at high pressure and at high temperature, arrives from the heat pump system as if such deicing system 70 in kit form were a normal internal exchanger, with the difference that it has a deicing fluid, such as for example water, and not air, as the exchange element.

For example, the secondary refrigeration circuit 80 of the deicing system 70 can be connected in input and in output to the existing heat pump system by way of two brass threadings of the specified diameters, to which the deicing system 70 is connected by way of sealing elements 73 and 75.

The coolant gas arrives at the input connector 75 and, once inside the secondary refrigeration circuit 80, meets a two-way, two-position opening control valve 83, which is adapted to activate (open) or deactivate (closed) the deicing system 70 as a function of the values of the external and internal ambient temperature, of the input and output temperature of the coolant gas, and of the humidity in contact with the external evaporator 11 of the system such values being measured by adapted probes or sensors 13, and also as a function of the needs of the context.

Once past the opening control valve 83, the coolant gas proceeds toward a three-way, two-position redirection valve 77, which makes it possible, according to the mode that has been set (heating or cooling), to direct the coolant gas directly toward a heat exchanger 85, preferably made of copper, through the by-pass 81; or to redirect the coolant gas toward a heat exchanger 79, which is constituted preferably by a copper capillary tube, and therefore evaporate the gas before the heat exchanger 85.

A storage tank 87 contains a deicing fluid, such as for example water, and internally comprises the heat exchanger 85 immersed, preferably totally, in the aforementioned deicing fluid.

In the first case, i.e. with the passage of the coolant gas through the by-pass 81, the water contained in the tank 87 is heated; while in the second case, i.e. with the passage of the coolant gas through the heat exchanger 79, the water contained in the tank 87 is cooled.

In a deicing circuit 90 connected in input and in output to the tank 87, the heated water is withdrawn by way of a circulation pump 91, which is connected to its ends to flow control valves 89 and 93.

The deicing circuit 90 also comprises a heat exchanger 97, which is positioned proximate to the external evaporator of the system, and is connected to the flow control valves 95 for the delivery and 99 for the return.

From inside the heat exchanger 56, the water dissipates the heat in the form of hot air toward such external evaporator, thus preventing any formation of frost or ice and keeping the conventional air conditioning system stable without arrests and swings in operation.

Finally, after exiting from the exchanger 97, the cooled water is reintroduced into the storage tank 87 by way of a flow control valve 103, which closes the deicing circuit 90.

In a preferred embodiment of the present disclosure, the deicing circuit 90 advantageously comprises an expansion vessel 101, which performs the function of containing the pressure variations of the circuit, thus preventing hazardous sudden changes and water hammers, which otherwise would have to be absorbed by the piping and by the rest of the system.

In a preferred embodiment of the present disclosure, the system for deicing the external evaporator in a heat pump system further comprises an electronic control system that continuously analyzes the working conditions (external temperature, external humidity etc.) of the external evaporating exchanger and which, if conditions are detected that are indicative of the formation of frost or ice, sends a command to send the heat exchangers 56 and 97, which are adapted to preheat air, a sufficient quantity of heat for melting.

In general, the principle on which the system for deicing the external evaporator in a heat pump system according to the disclosure is based is different from the one currently in use, in which all the heat produced by the operation of the heat pump is dispersed into the environment.

In fact, in the present disclosure, a part of the heat produced by the heat pump during its operation is not dispersed into the environment, but is accumulated, by way of the deicing fluid contained in the storage tanks 34 and 87, and used, if and when needed, to heat the external cold air in contact with the heat exchangers 56 and 97, which prevents the formation of frost or of ice on the surface of the external evaporator of the system.

In practice it has been found that the disclosure fully achieves the set advantages and features. In particular, it has been seen that the system for deicing the external evaporator in a heat pump system thus conceived makes it possible to overcome the qualitative limitations of the known art, in that it makes it possible to completely substitute the step of deicing during the operation of the system, i.e. to avoid the periodic execution of deicing cycles that interrupt the operation of the system in heating mode, consequently avoiding frequent cooling fluid cycle inversions and repeated preheating operations.

Compared to conventional solutions, the system for deicing the external evaporator in a heat pump system according to the disclosure is more efficient in energy terms, since it needs less energy in order to obtain the same level of heating, and is more convenient in economic terms, in that a significant reduction in the energy costs is obtained for a modest increase in the production costs of the system.

Another advantage of the system for deicing the external evaporator in a heat pump system according to the disclosure is that it makes it possible to spare the apparatus from conditions of excessive stress, in this manner ensuring greater reliability of the mechanical and electrical parts, especially over the long term of service, and a consequent reduction of the number of maintenance operations necessary.

Another advantage of the system for deicing the external evaporator in a heat pump system according to the disclosure is that it makes it possible to increase performance in terms of absorptions, both in heating mode (SCOP) and in cooling mode (SEER).

Although the system for deicing the external evaporator in a heat pump system according to the disclosure has been devised in particular for use in conditioning systems adapted to heat or cool residential, commercial or industrial buildings, it can also be used, more generally, for use in any apparatus or system that comprises a heat pump machine, the external evaporator of which is subject to the formation on its surface of frost or ice, in particular in heating mode when it operates as an evaporator.

The disclosure, thus conceived, is susceptible of numerous modifications and variations. Moreover, all the details may be substituted by other, technically equivalent elements.

In practice, the materials used, as well as the contingent shapes and dimensions, may be any according to requirements and to the state of the art.

The disclosures in Italian Patent Application No. 102015000048188 (UB2015A003364) from which this application claims priority are incorporated herein by reference.

The invention claimed is:

1. A system for deicing an external evaporator in a heat pump system, comprising:

a refrigeration circuit, connected in input and in output to said heat pump system and adapted to convey coolant gas, said refrigeration circuit comprising a tank for storing a deicing fluid, and a first heat exchanger immersed in said deicing fluid; and a deicing circuit connected in input and in output to said tank and adapted to convey said deicing fluid, said deicing circuit comprising a second heat exchanger;

a plurality of sensors adapted to detect external and internal ambient temperature, input and output temperature of a coolant gas of the heat pump system, and humidity in contact with said external evaporator;

said second heat exchanger being arranged proximate to said external evaporator, wherein said refrigeration circuit comprises a two-way, two-position opening control valve, adapted to activate or deactivate said system for deicing as a function of the values of the external and internal ambient temperature, of the input and output temperature of a coolant gas of the heat pump system, and of the humidity in contact with said external evaporator.

2. The system for deicing the external evaporator in the heat pump system according to claim 1, wherein said refrigeration circuit comprises a three-way, two-position redirection valve and a third heat exchanger, which are adapted to make said system operate in cooling mode.

3. The system for deicing the external evaporator in the heat pump system according to claim 1, wherein said refrigeration circuit comprises a gas accumulator.

4. The system for deicing the external evaporator in the heat pump system according to claim 1, wherein said refrigeration circuit comprises a liquid accumulator and a liquid separator.

5. The system for deicing the external evaporator in the heat pump system according to claim 1, wherein said deicing circuit comprises a circulation pump.

6. The system for deicing the external evaporator in the heat pump system according to claim 1, wherein said deicing circuit comprises a check valve.

7. The system for deicing the external evaporator in the heat pump system according to claim 1, wherein said deicing circuit comprises an expansion vessel.

8. The system for deicing the external evaporator in the heat pump system according to claim 1, wherein said first heat exchanger is made of copper.

9. The system for deicing the external evaporator in the heat pump system according to claim 2, wherein said third heat exchanger is constituted by a capillary tube made of copper.

* * * * *